US010543998B2

(12) United States Patent
Langhuber et al.

(10) Patent No.: US 10,543,998 B2
(45) Date of Patent: Jan. 28, 2020

(54) APPARATUS FOR ALIGNING NOTES OF VALUE

(71) Applicant: Wincor Nixdorf International GmbH, Paderborn (DE)

(72) Inventors: Dirk Langhuber, Paderborn (DE); Thomas Kemmerling, Brilon-Madfeld (DE); Michael Schild, Paderborn (DE); Ludger Hoischen, Borchen (DE); Paul Freitag, Steinheim (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 15/923,063

(22) Filed: Mar. 16, 2018

(65) Prior Publication Data

US 2018/0265317 A1 Sep. 20, 2018

(30) Foreign Application Priority Data

Mar. 17, 2017 (DE) ..... 10 2017 105 842

(51) Int. Cl.
*B65H 9/00* (2006.01)
*G07D 11/17* (2019.01)
(Continued)

(52) U.S. Cl.
CPC ..... *B65H 9/002* (2013.01); *B65H 5/062* (2013.01); *G07D 11/17* (2019.01); *G07D 11/40* (2019.01);
(Continued)

(58) Field of Classification Search
CPC .... B65H 2404/696; B65H 9/002; B65H 9/10; B65H 5/062
See application file for complete search history.

(56) References Cited

U.S. PATENT DOCUMENTS 4,959,685 A * 9/1990 Kato ..... G03G 15/6538 271/214
4,977,432 A * 12/1990 Coombs ..... B65H 29/52 162/271
(Continued)

FOREIGN PATENT DOCUMENTS

DE 3041410 A1 2/1982
DE 10203177 C1 7/2003
(Continued)

OTHER PUBLICATIONS

Extended European Search Report issued for the parallel European patent application; 8 pages.

*Primary Examiner* — Howard J Sanders

(57) ABSTRACT

An apparatus for aligning at least one note of value along a transport path includes at least one transport element driven by at least one first drive unit and at least one counter-pressure element arranged opposite to the transport element. The transport path of the note of value extends between the transport element and the counter-pressure element. The counter-pressure element is ball-shaped and is mounted so as to be freely rotatable. Further, the apparatus includes a second drive unit for displacing the transport element along its axis of rotation so that a note of value arranged between the transport element and the counter-pressure element is moved transversely to the transport direction during displacement of the transport element.

10 Claims, 9 Drawing Sheets

(51) Int. Cl.

| | |
|---|---|
| ***G07D 11/40*** | (2019.01) |
| ***B65H 5/06*** | (2006.01) |
| *B65H 9/10* | (2006.01) |
| *G07F 19/00* | (2006.01) |

(52) U.S. Cl.
CPC ..... *B65H 9/10* (2013.01); *B65H 2701/1912* (2013.01); *G07D 2211/00* (2013.01); *G07F 19/20* (2013.01)

(56) References Cited

U.S. PATENT DOCUMENTS

| | | | | | |
|---|---|---|---|---|---|
| 5,413,326 | A * | 5/1995 | Wright | B65H 29/12 | 271/184 |
| 5,577,719 | A * | 11/1996 | Nicoll | B65H 9/166 | 271/227 |
| 6,053,494 | A * | 4/2000 | Baskette | B65H 29/60 | 271/251 |
| 8,348,267 | B2 * | 1/2013 | Storey | B65H 5/062 | 271/228 |
| 2013/0307213 | A1 | 11/2013 | Adachi | | |
| 2015/0132016 | A1 | 5/2015 | Aoki | | |
| 2016/0101958 | A1 | 4/2016 | Park et al. | | |
| 2016/0272448 | A1 | 9/2016 | Nakai | | |
| 2016/0280487 | A1 | 9/2016 | Koizumi et al. | | |

FOREIGN PATENT DOCUMENTS

| | | | |
|---|---|---|---|
| DE | 102004060191 | A1 | 6/2006 |
| DE | 102008038771 | A1 | 2/2010 |
| DE | 102008050524 | A1 | 4/2010 |
| DE | 102011000783 | A1 | 8/2012 |
| EP | 03015409 | A1 | 4/2016 |
| FR | 02857655 | A1 | 1/2005 |
| WO | 2011151984 | A1 | 12/2011 |

* cited by examiner

APPARATUS FOR ALIGNING NOTES OF VALUE

CROSS-REFERENCE TO RELATED APPLICATIONS

This application claims priority to and the benefit of German Patent Application No. 10 2017 105 842.7, Filed 17 Mar. 2017, the contents of which are hereby incorporated by reference in their entirety.

BACKGROUND AND SUMMARY

The invention relates to an apparatus for aligning notes of value during the transport along a transport path, for example within an automated teller machine or an automatic cash safe or a cash register system. The note of value can in particular be a banknote or a check, which shall for example be fed to a receiving area of a box for storing notes of value or shall be removed therefrom. The apparatus includes at least one transport element for transporting the note of value along the transport path. The transport element is driven by at least one first drive unit. The apparatus further comprises at least one counter-pressure element arranged opposite to the transport element. The transport element can in particular be a roller, a drum, or a band.

In value note machines, such as automated teller machines, automatic cash safes as well as machines for the output and/or input of vouchers and tickets, notes of value to be input are transported from an input compartment into a receiving area and/or notes of value to be output are transported from a receiving area to an output compartment. The receiving area can be provided by a transport box for storing and for transporting the notes of value. To achieve a value note throughput that is as high as possible during the transport of the notes of value and to avoid disturbances resulting from value note jams, so-called paper jams, the usually rectangular notes of value are oriented with their longitudinal axis transversely to the transport direction. Such an orientation is also referred to as long-side first orientation. The risk of a paper jam is particularly high in the case of used notes of value since the stiffness of such notes of value decreases with use and contaminations of the surface of the notes of value increase. Especially in the case of such used notes of value, a skewed feed or skewed pull of the notes of value during transport may occur. As a result, the notes of value can have a lateral offset or an angular offset with respect to a desired target position so that these should be aligned.

An apparatus for aligning notes of value is for example known from document DE 10 2004 060 191 A1. In this apparatus, lateral guiding elements, as used for example for aligning and guiding single sheets in printers or copiers, are dispensed with. In the case of notes of value, the use of lateral guiding elements would result in a misalignment and/or a disturbance as a result of a paper jam due to the different stiffnesses and the different edge qualities of notes of value. Further apparatuses for aligning notes of value are known from documents DE 10 2008 050 534 A1, DE 10 2008 038 771 A1, DE 10 2011 000 783 A1 and DE 102 03 177 C1.

It is the object of the invention to specify an apparatus for aligning a note of value, by which at least a lateral offset of the note of value can be corrected easily during its transport along the transport path.

This object is solved by an apparatus for aligning at least one note of value along a transport path having the features of claim 1. Advantageous developments of the invention are specified in the dependent claims.

In the apparatus for aligning at least one note of value along a transport path having the features of claim 1, the counter-pressure element is designed in a ball-shaped manner and is mounted in a freely rotatable manner as compared to the known prior art. Further, a second drive unit for displacing the transport element arranged opposite to the ball-shaped counter-pressure element along its axis of rotation is provided so that a note of value arranged between the transport element and the counter-pressure element is moved transversely to the transport direction upon displacement of the transport element. When the note of value is additionally moved in transport direction or in opposite transport direction by way of a drive by the first drive unit, the note of value is transported obliquely to the transport direction when the second drive unit is simultaneously activated so that a lateral offset is generated. As a result, a very compact and robust structure of the apparatus is possible. The inventive apparatus can alternatively or additionally be used in apparatuses for handling notes of value, such as automated teller machines, automatic cash safes, ticket machines, or cash register systems.

In an advantageous development, the first drive unit drives the transport element via at least one drive shaft. As a result, an easy drive of the transport element is possible. Further, the transport element can easily be displaced together with or on the drive shaft by the second drive unit.

In a further advantageous embodiment of the invention, the ball-shaped counter-pressure element presses a note of value arranged between the transport element and the counter-pressure element against the circumferential surface of the transport element. As a result, the transport element can be arranged at a distance that is constant with respect to a transport plane of the transport path so that the transport element itself does not exert a force on a note of value arranged between the transport element and a counter-pressure element orthogonally to the transport plane, whereas the counter-pressure element exerts a force on the note of value in the direction of the transport element. This press-on force substantially extends orthogonally or obliquely to the transport plane. As a result, a simple and robust structure of the apparatus is possible.

Further, it is advantageous when during a rotation of the transport element using a drive by the first drive unit the second drive unit displaces the transport element so that the transport of the note of value takes place obliquely to the transport direction. Thus, the note of value is simultaneously displaced transversely to the transport direction and transported in transport direction. As a result, the note of value is continuously moved in transport direction T1 independent of whether a transport of the note of value transversely to the transport direction for reducing or correcting a lateral offset of the note of value in transport direction takes place or not. Thus, the note of value runs through the apparatus in the same period of time, independent of whether the note of value is moved transversely to the transport direction or not during the transport through the apparatus by the second drive unit.

Further, it is advantageous when the transport element is connected to at least one drive shaft in a rotationally fixed manner and is axially displaceable thereon. As a result, an easy drive of the transport element at the same rotational speed at which also the drive shaft is driven takes place. By the axial displaceability of the transport element on the drive shaft, the transport element can be displaced easily transversely to the transport direction by the second drive unit. As a result, a simple and compact structure of the apparatus is achieved.

It is particularly advantageous when the transport element comprises at least one roller pair, the rollers of which are connected via a connecting element with circumferential toothing in the manner of a toothed rack and that the connecting element is arranged displaceably together with the rollers along the axis of rotation of the rollers on at least one drive shaft. As a result, an easy drive of the rollers and a simple force transmission from the second drive unit to the connecting element for displacing the rollers of the roller pair in the direction of their axes of rotation is possible. The circumferential toothing is preferably engaged with a gearwheel that is drivable by the second drive unit. The second drive unit is preferably an electric motor, in particular a stepper motor. As a result, an easy drive and a simple force transmission onto the connecting element for displacing the rollers is possible. In particular, in this way a compact structure of the apparatus is possible.

Here, it is particularly advantageous when the toothing of the gearwheel is engaged with the circumferential toothing of the connecting element so that in the case of a rotation of the gearwheel caused by the second drive unit the transport element on the drive shaft is displaced axially. As a result, the rollers of the roller pair or the transport element can be displaced easily along their axes of rotation on the drive shaft.

Further, it is advantageous when the transport path of the notes of value is delimited by a first guide element and by a second guide element, wherein the first guide element is arranged opposite to the second guide element such that it is pivotable from an operating position into a maintenance position. As a result, during the transport of the notes of value through the apparatus the notes of value are guided by the guide elements. Further, in the case of a paper jam or for maintenance purposes a simple access to the transport path and the transport elements is possible.

In other embodiments, the guide elements can also be arranged such that they are not pivotable relative to each other.

In a further advantageous embodiment, at least two ball-shaped counter-pressure elements are provided, which are respectively preferably arranged opposite to a roller of a driven roller pair serving as a transport element. Here, it is advantageous when the first ball-shaped counter-pressure element is arranged freely rotatable in a first bearing unit and when the second ball-shaped counter-pressure element is freely rotatably in a second bearing unit. The bearing units can be connected pivotably with the first guide element, wherein the first ball-shaped counter-pressure element projects through an opening of the first bearing unit which is preferably dimensioned such that the first ball-shaped counter-pressure element cannot completely be moved through the opening. Further, it is advantageous when the second ball-shaped counter-pressure element projects through an opening of the second bearing unit, which is preferably dimensioned such that the second ball-shaped counter-pressure element cannot completely be moved through the opening. As a result, it is achieved that the balls serving as a counter-pressure element cannot fall out of the bearing units when the counter-pressure elements are lifted from the opposite transport element or from the opposite rollers of the roller pair. In the bearing unit, bearing bushes can be provided in which the balls of the ball-shaped counter-pressure elements are mounted in a freely rotatable manner.

In a further advantageous embodiment, the apparatus comprises at least one elastically deformable element, which generates a press-on force of the ball-shaped counter-pressure element on a note of value arranged between the transport element and the counter-pressure element. As a result, it is easily possible to exert a desired press-on force on the ball-shaped counter-pressure element and thus on a note of value arranged between the counter-pressure element and the transport element.

In a further embodiment, it is advantageous when the transport element comprises a first roller and a second roller, wherein the first roller is arranged on a first drive shaft in a rotationally fixed manner and is axially displaceable along the longitudinal axis of the first drive shaft and when the second roller is arranged on a second drive shaft in a rotationally fixed manner and is axially displaceable along the longitudinal axis of the second drive shaft. The first drive shaft is drivable by the first drive unit. The second drive shaft is drivable by a third drive shaft. The first roller and the second roller are coupled to each other via a connecting element such that they are displaceable together with the connecting element along the axis of rotation of the rollers or along the central axis of the first drive shaft and the second drive shaft. The connecting element preferably has a circumferential toothing in the manner of a toothed rack. At least one of the rollers is arranged so as to be freely rotatable with respect to the connecting element so that the rollers are drivable at different rotational speeds. The first drive unit and the third drive unit can be controlled such that they have different rotational speeds so that in the case of different rotational speeds a rotation of the note of value about an axis of rotation running perpendicular to the transport plane of the transport path takes place. As a result, also an angular offset with respect to a target position can be corrected or at least reduced simultaneously to a lateral offset.

In a further advantageous embodiment, the apparatus has a banknote reader, which detects the position of the note of value. Based on the detected position, the banknote reader or a control unit determines a lateral offset with respect to a preset target position. The alignment of the note of value then takes place in that the second drive unit for moving the transport element is controlled dependent on the determined lateral offset such that the lateral offset is reduced or corrected. As a result, an easy detection of the lateral offset is possible. Since banknote readers are generally used in automated teller machines for an authenticity check, it is advantageous to use this device already present in the automated teller machine to detect the position of the note of value in order to determine a lateral offset of the note of value based thereon.

In a further advantageous embodiment, the direction of rotation of the transport element can be changed. This in particular takes place by a change of the direction of rotation of the first drive unit. As a result, a bidirectional transport of the notes of value along the transport path in a first transport direction and in a second transport direction opposite to the first transport direction is possible. As a result, it is in particular possible to transport notes of value to be deposited in the first transport direction through the apparatus and notes of value to be dispensed in the second transport direction. Further, it is possible to transport a note of value in the first transport direction through the apparatus and in doing so to perform a first correction of the lateral offset and, given a transport of the same note of value in the second transport direction through the apparatus, to perform a second correction of the lateral offset. As a result, the possibility for correcting a determined lateral offset is further improved.

A second aspect of the invention relates to an arrangement with a first apparatus according to claim 1 or a claim dependent on claim 1 or according to one of the embodiments indicated above and with a second apparatus according to claim 1 or a claim dependent on claim 1 or a development indicated above. The note of value is successively fed to the first apparatus and the second apparatus. In doing so, a first alignment of the note of value can be made by the first apparatus and a second alignment of the note of value can be made by the second apparatus. As a result, a lateral offset that is twice as high can be corrected as compared to arrangements with only one apparatus for correcting a lateral offset of a note of value.

The transport path is preferably limited by several transport elements, of which at least a part is arranged one after the other in transport direction. Further, the transport path can be arranged between a first guide element and a second guide element. In particular, the transport elements can be arranged such and the guide elements can be designed such that the transport plane has a curved or curve-shaped course in transport direction. A note of value transported along the transport path is transported along the transport path such that its face is arranged opposite to a contact area of the first guide element and that its back is arranged opposite to a contact area of the second guide element.

The transport elements can comprise driven and/or non-driven rotating transport rollers, transport bands, and/or drums.

The note of value can in particular be a banknote, a check, a voucher, or a ticket.

Further features and advantages of the invention result from the following description, which explains the invention in more detail in connection with the enclosed Figures on the basis of an embodiment.

DETAILED DESCRIPTION

Figure 1:
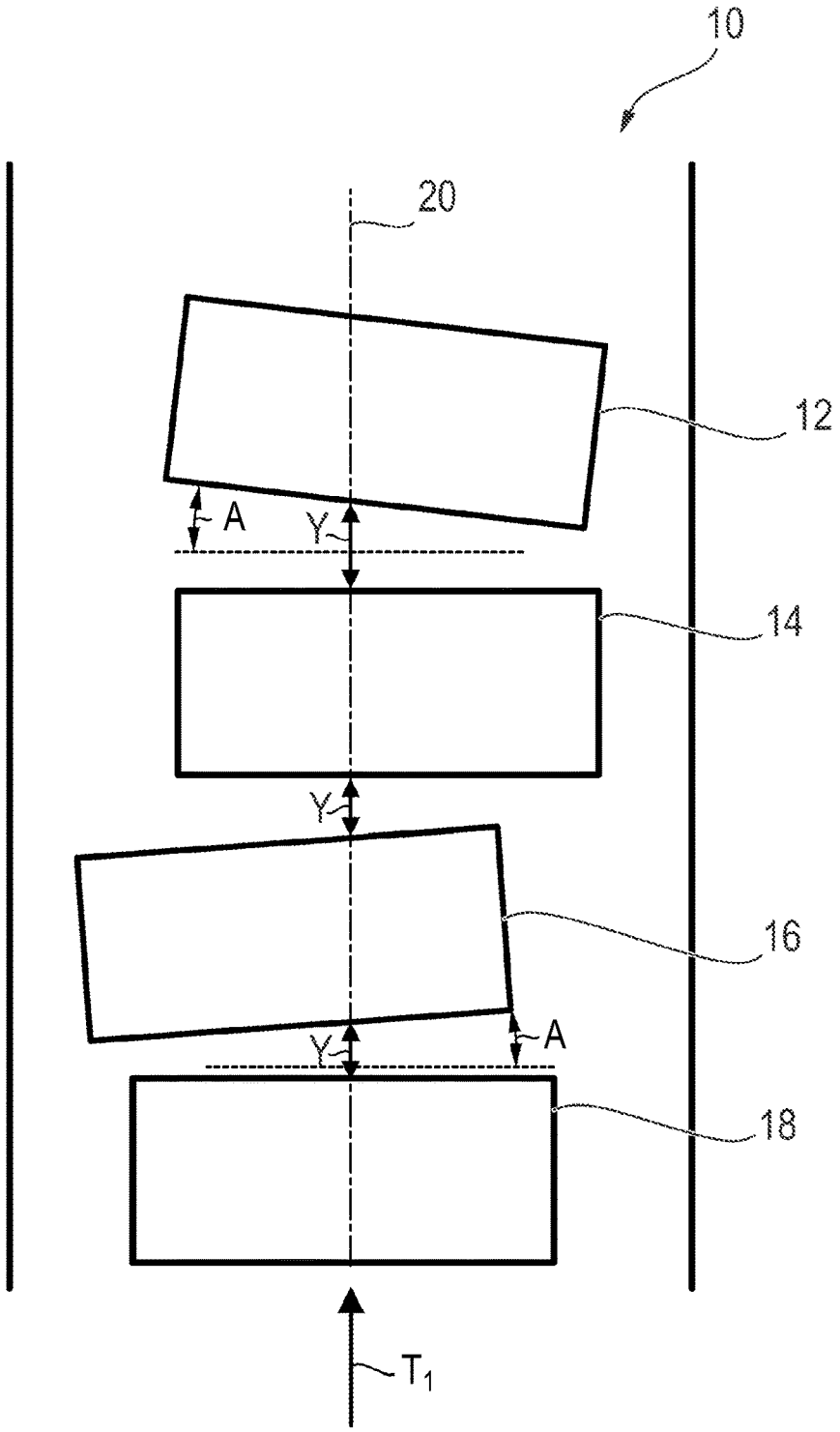
FIG. 1 shows a schematic illustration of several notes of value transported along a transport path.

In FIG. 1, a schematic illustration of several notes of value 12 to 18 arranged along a transport plane 10 is illustrated. The notes of value 12 to 18 are transported by means of non-illustrated transport means, such as rollers, drums, bands, and/or switches along the transport path 10 in transport direction T1. The dash-dotted line 20 indicates the central axis of the transport path 10. The notes of value 12 to 18 are transported in a transport plane formed by the transport path 10. In the following, such a transport plane is likewise identified with the reference sign 10.

The notes of value 12 to 18 should have a target position relative to the transport path 10. From this target position, the positions of the notes of value 12 to 18 should only deviate within little tolerances. In the target position, the longitudinal sides of the notes of value 12 to 18 are aligned orthogonally to the transport direction T1 and the short central axis of the note of value 12 to 18 lies on the central axis 20 of the transport path 10. From the notes of value 12 to 18 illustrated in FIG. 1, only the note of value 18 is in the target position. In the present embodiment, the longitudinal sides of the notes of value 12 to 18 are, at least in the target position, oriented substantially transversely to the transport direction T1. Such an orientation of the longitudinal sides of the notes of value 12 to 18 orthogonal to the transport direction T1 is also referred to as long side first (LSF) orientation. Further, it is advantageous when two successive notes of value 12 to 18 each have the same distance Y to each other. An alignment of the notes of value 12 to 18 in the target position is particularly important when the notes of value 12 to 18 are transported along the transport path 10 of an automated teller machine or an automatic cash safe at high speed. For aligning the notes of value 12 to 16, the position of which laterally deviates from the target position, an apparatus for aligning the notes of value 12 to 18 is provided according to the invention. The structure and the function of the apparatus for aligning notes of value 12 to 18 is described still in more detail in the following in connection with FIGS. 2 to 9. The notes of value 12 to 18 run through the apparatus at the same transport speed as during their transport along other transport paths 10 in the automated teller machine or in the automatic cash register system or cash safes, respectively. In the present embodiment, the deviation of the position of the note of value 12 to 18 from its target position is determined by a non-illustrated value note checking unit for checking the authenticity of the notes of value 12 to 18. The value note checking unit is arranged upstream of the apparatus for aligning the notes of value 12 to 18 in transport direction T1. Such a value note checking unit is also referred to as banknote reader.

Deviations of the position of the notes of value 12 to 18 from the target position can in particular occur during the removal of notes of value 12 to 18 from value note boxes with poorly stacked notes of value 12 to 18, in the case of an incorrect input of notes of value 12 to 18 by a customer and/or in the case of a skewed pull of notes of value 12 to 18 during feed or during the transport along the transport path 10. When such deviations occur, it is necessary that the notes of value 12 to 18 are brought into their target position by the apparatus for aligning notes of value 12 to 18 in order to correct at least a detected lateral offset.

Further, by the alignment of the notes of value 12 to 18 in the target position, the alignment of the notes of value 12 to 18 in stacks for the output of the notes of value 12 to 18 as a bundle or for storing the notes of value 12 to 18 as a stack, for example in a value note box, is improved. In this way, the notes of value 12 to 18 can be stored in a space-saving manner. Further, the notes of value 12 to 18 can be output to a customer as an orderly bundle in an attractive and comfortable manner.

The note of value 14 shown in FIG. 1 is not in the target position. Its longitudinal sides are indeed perpendicular to the transport direction T1, but its short central axis does not lie on the central axis 20 of the transport path 10. The short central axis of the note of value 14 is offset to the right so that the note of value 14 has no angular offset but a lateral offset. The note of value 14 thus has to be moved to the left so far that the short central axis of the note of value 14 lies on the central axis 20 of the transport plane 10 to bring the note of value 14 in the target position.

The note of value 12 has approximately the same lateral offset transversely to the central axis 20 of the transport path 10 as the note of value 14. However, the note of value 12 is additionally rotated by an angle A with respect to an orthogonal to the central axis 20 of the transport path 10. Such a deviation by an angle from the target position is also referred to as angular offset. The note of value 12 should be rotated by the angle −A and additionally be moved to the left, as viewed in transport direction T1, until the short central axis of the note of value 12 lies on the central axis 20 of the transport path 10 to bring the note of value 12 exactly into the target position.

The note of value 16 has an angular offset of −A and a lateral offset transversely to the central axis 20 of the transport path 10 to the left as viewed in transport direction T1. To bring this note of value 16 into the target position, it has to be rotated by the angle A and moved to the right until the short central axis of the note of value 16 lies on the central axis 20 of the transport plane 10. It has been realized that in many cases it is sufficient to correct the lateral offset of a note of value. A correction of the angular offset is not absolutely necessary in many cases.

Figure 2:
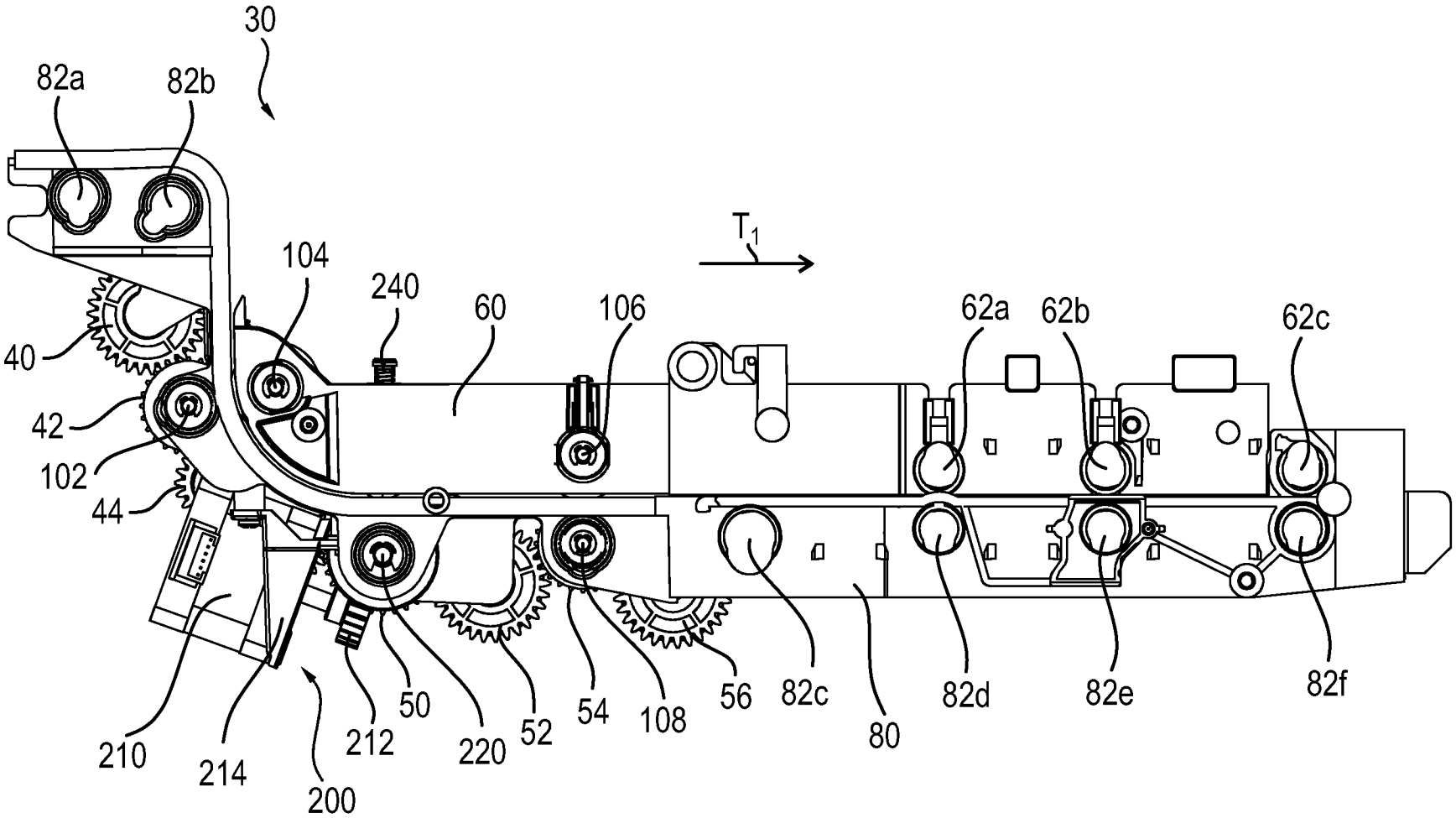
FIG. 2 shows a side view of a transport unit with an apparatus for aligning notes of value according to a first embodiment of the invention.

In FIG. 2, a side view of a transport unit 30 with an apparatus 200 for aligning notes of value 12 to 18 is shown. The transport path 10 of the notes of value 12 to 18 is delimited by an upper part serving as a first guide element 60 and by a lower part serving as a second guide element 80.

The transport unit 30 comprises several drive shafts, of which three drive shafts 102, 108 and 220 are illustrated in FIG. 2. The direction of rotation of the drive shafts 102, 108 and 220 determines the direction of transport T1 of the notes of value 12 to 18. The drive shafts 102, 108 and 220 are mounted in the lower part 80 freely rotatably via bearings so that the notes of value 12 to 18 can be transported in a transport direction T1 or opposite to the transport direction T1 through the transport unit 30.

The transport unit 30 moreover comprises two non-driven transport shafts 104 and 106, which are mounted in the upper part 60 via bearings so as to be freely rotatable and are arranged opposite to the drive shafts 102 and 108.

Figure 6:
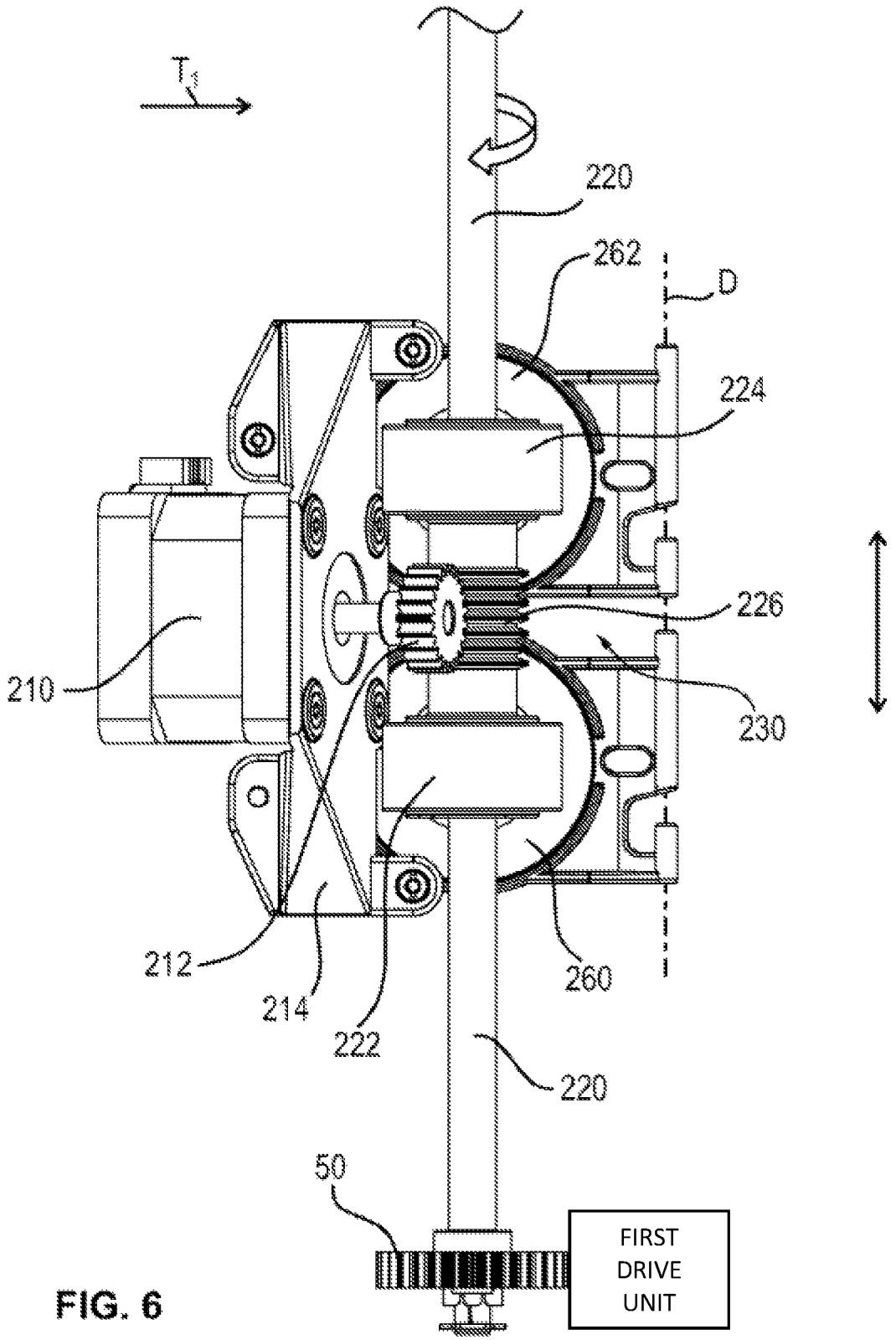
FIG. 6 shows a bottom view of the apparatus for aligning notes of value according to FIG. 5.
Figure 8:
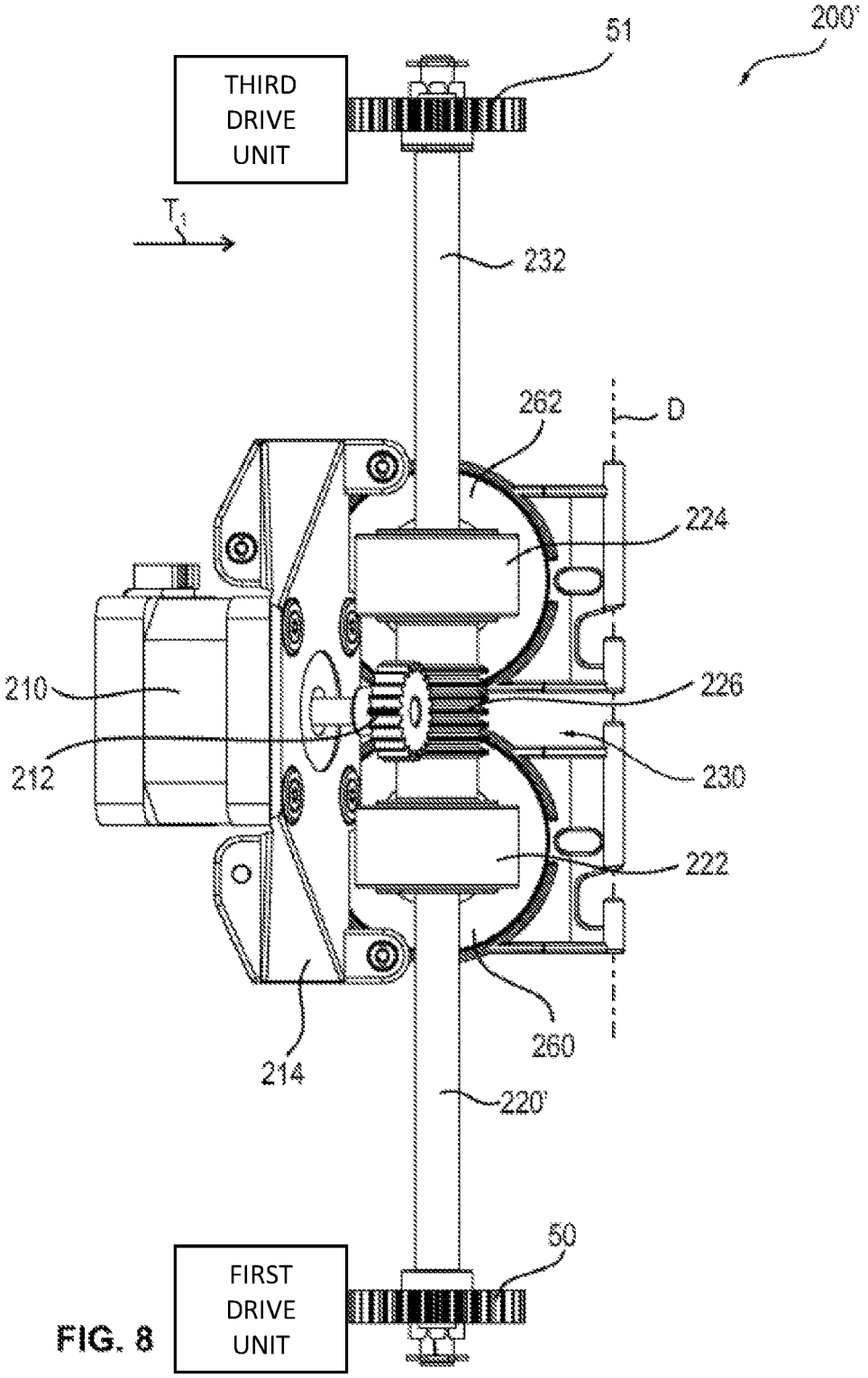
FIG. 8 shows a bottom view of an apparatus for aligning notes of value according to a second embodiment of the invention.

Via gearwheels 40 to 56, the drive shafts 102, 108 and 220 are engaged with each other so that the drive shafts 102, 108 and 220 are drivable by a first drive unit shown schematically in FIG. 6 and FIG. 8. The first drive unit can be a central drive unit of the transport unit.

Further, the first guide element 60 has three openings 62*a* to 62*c* and the second guide element 80 has six openings 82*a* to 82*f*, which serve to receive and mount further drive and transport shafts (not illustrated).

The apparatus 200 for aligning notes of value comprises a second drive unit 210 which drives a gearwheel 212 and which is firmly connected to the lower part 80 via a holding device 214.

Figure 3:
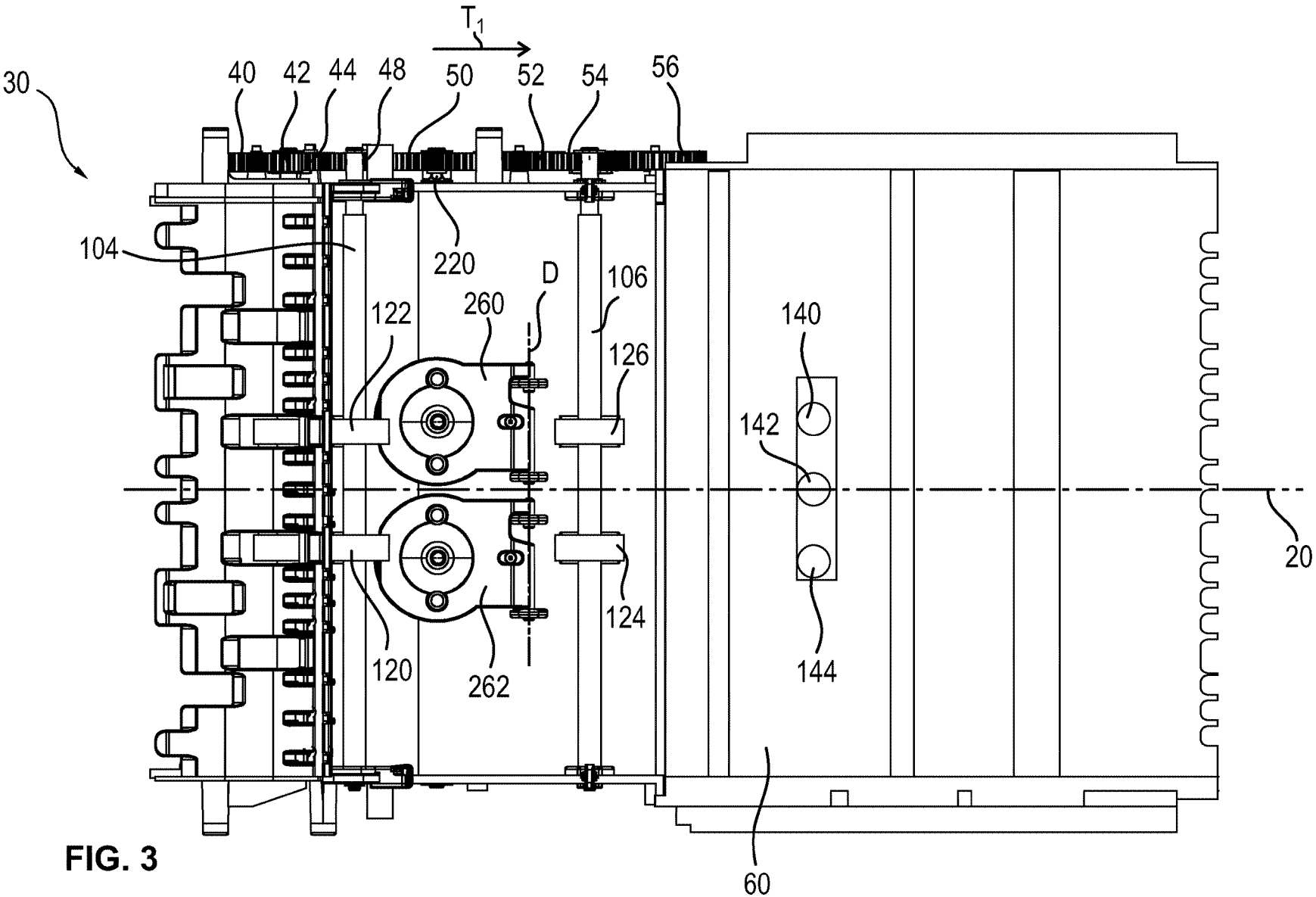
FIG. 3 shows a top view of the transport unit according to FIG. 2.
Figure 5:
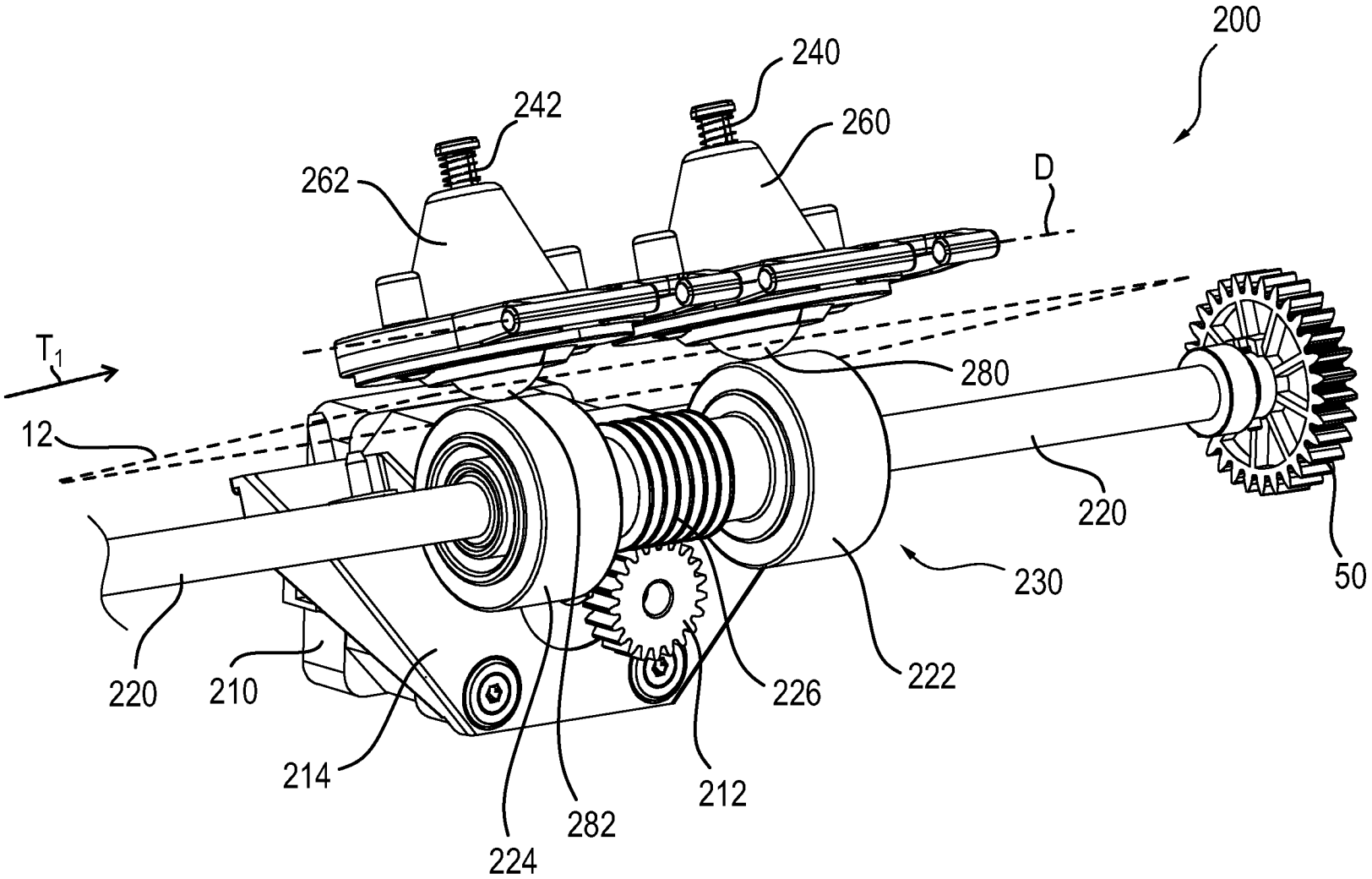
FIG. 5 shows a schematic perspective illustration of the apparatus for aligning notes of value of the transport unit according to FIGS. 1 to 4.

FIG. 3 shows a top view of the transport unit according to FIG. 2. Two press-on units 260 and 262 are pivotably connected to the first guide element 60 about a pivot axis D. Inside the press-on units 260, 262, each time a ball is mounted freely rotatably, which ball serves as a ball-shaped counter-pressure 280 and 282. The ball-shaped counter-pressure elements 280, 282 are covered in the illustration according to FIG. 3, their arrangement is shown in FIG. 5. The press-on units 260, 262 are generally also referred to as bearing units.

Further, two roller pairs are visible. The first roller pair comprises the rollers 120 and 122 and the second roller pair comprises the rollers 124 and 126. The first roller pair is firmly connected to the transport shaft 104 and the second roller pair is firmly connected to the transport shaft 106.

Figure 4:
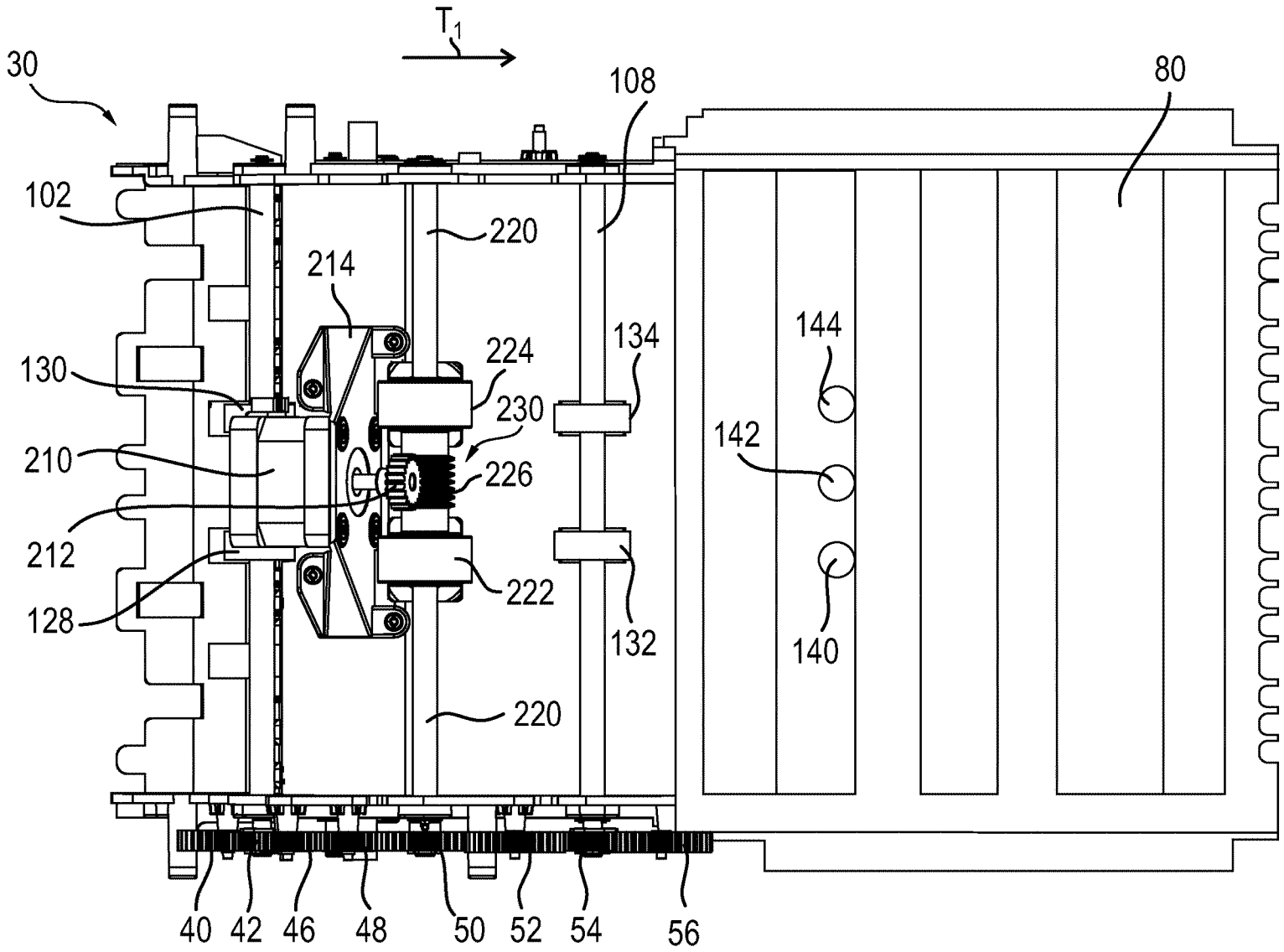
FIG. 4 shows a bottom view of the transport unit according to FIGS. 2 and 3.

The rollers 120, 122, 124 and 126 are arranged on the transport shafts 104 and 106 such that the lateral distance of the rollers 120 and 124 to the central axis 20 is identical to the lateral distance which the rollers 122 and 126 that are arranged on the opposite side of the central axis 20 have to the central axis 20. The rollers 120 and 126 are not driven and thus only rotate when they are pressed against respectively opposite drive rollers 128 to 134 or against a note of value 12 to 18 arranged between the respective roller 120 to 124 and the drive roller 128 to 134 opposite thereto. The drive rollers 128 to 134 are covered by the rollers 120 to 124 in the illustration according to FIG. 3, their exact arrangement is shown in FIG. 4. In other embodiments, the rollers can be arranged so as to be freely rotatable and non-displaceable in axial direction on the transport shafts 104, 106.

The openings 140 to 144 present downstream of the transport shaft 106 in transport direction T1 serve to receive sensor elements for detecting the position and location of the notes of value 12 to 18. The signals generated by the sensor elements are evaluated in a non-illustrated control unit and a possible or current lateral and/or angular offset and/or a paper jam of the fed notes of value 12 to 18 is detected and/or a value note tracking is performed.

FIG. 4 shows a bottom view of the transport unit 30 according to FIGS. 2 and 3 in which the second guide element 80 as well as the underside of the apparatus 200 for aligning notes of value 12 to 18 is visible. The apparatus 200 comprises a transport element 230 consisting of the rollers 222, 224 and their connecting element 226. The rollers 222, 224 and the connecting element are connected to the drive shaft 220 in a rotationally fixed manner and axially displaceable thereon. The connecting element 226 comprises a circumferential toothing in the manner of a toothed rack into which a gearwheel 212 engages that is driven by the second drive unit 210. When the gearwheel 212 is rotated by the second drive unit, an axial displacement of the transport element 230 on the drive shaft 220 takes place.

Further, two drive roller pairs are visible, the first one comprises the drive rollers 128 and 130 firmly connected to the drive shaft 102 and the second one comprises the driver rollers 132 and 134 firmly connected to the drive shaft 108.

The drive rollers 128 to 134 are preferably each arranged exactly opposite to one of the rollers 120 to 126 illustrated in FIG. 3. Thus, the drive roller 128 is arranged opposite to the roller 122, the drive roller 130 is arranged opposite to the roller 120, the drive roller 132 is arranged opposite to the roller 126, and the drive roller 134 is arranged opposite to the roller 124.

FIG. 5 shows a schematic perspective illustration of the apparatus 200 for aligning notes of value 12 to 18, which forms part of the transport unit 30 according to FIGS. 1 to 4.

The apparatus 200 comprises a transport element 230 with rollers 222 and 224 and with a connecting element 226, a drive shaft 220 which is driven via a first drive unit shown schematically in FIG. 6 and FIG. 8, and a drive unit 210 which drives a gearwheel 212 which engages with a circumferential toothing of the connecting element 226. The rotation of the gearwheel 212 causes an axial displacement of the transport element 230 on the drive shaft 220 along the axis of rotation of the drive shaft or the axis of rotation of the rollers 222 and 224.

Further, the apparatus 200 comprises two ball-shaped counter-pressure elements 280 and 282, each of which being arranged opposite to a roller 222 and 224 of the transport element 230 and each of which being mounted in a bearing unit 260 and 262 so as to be freely rotatable. The bearing units 260 and 262 are connected to the first guide element 60 pivotably about the pivot axis D. The bearing units 260 and 262 are each connected with an elastically deformable element 240 and 242, which, as a result, cause a counter-pressure force of the ball-shaped counter-pressure elements 280 and 282 on a note of value 12, arranged between the transport element 230 and the counter-pressure elements 280 and 282.

When a note of value 12 is arranged between the rollers 222, 224 of the transport element 230 and the counter-pressure elements 280, 282 during the transport along the transport path 10, it is pressed against the circumferential surface of the rollers 222, 224 by the counter-pressure elements 280, 282. During the rotation of the transport element 230 via the drive shaft 220, the rollers 222, 224 of the transport element 230 are axially displaced by the second drive unit 210 on the drive shaft 220 so that the note of value 12 is transported obliquely to the transport direction T1.

FIG. 6 shows a bottom view of the apparatus 200 for aligning notes of value 12 to 18 according to FIG. 5.

Figure 7:
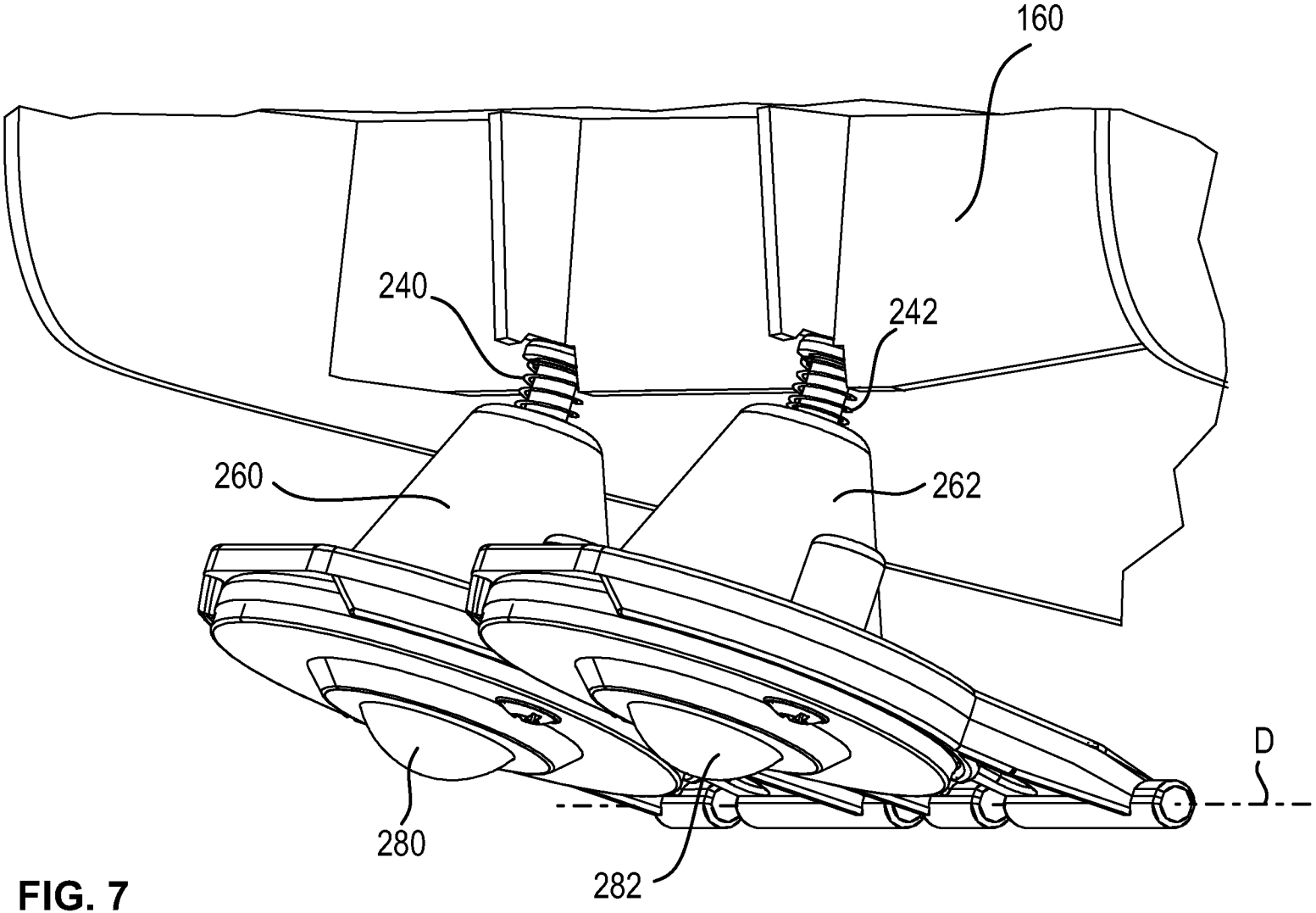
FIG. 7 shows a schematic perspective illustration of a part of the apparatus for aligning notes of value according to FIGS. 1 to 6.

FIG. 7 is a perspective illustration of the bearing units 260 and 262, in the inside of which the two ball-shaped counter-pressure elements 280 and 282 formed as balls being mounted freely rotatably in a bearing bush (not illustrated). Thus, the ball-shaped counter-pressure element 280 is mounted in the bearing unit 260; the ball-shaped counter-pressure element 282 is mounted in the bearing unit 262. The ball-shaped counter-pressure elements 280 and 282 project through an opening of the respective bearing unit 260 and 262, which is dimensioned such that these cannot completely be moved through the opening.

The bearing units 260 and 262 are each coupled with an elastically deformable element 240 and 242, which generates a counter-pressure force of the ball-shaped counter-pressure elements 240 and 242 on a note of value 12 arranged between the transport element 230 and the counter-pressure elements 280 and 282, as already described in connection with FIG. 5.

The elastically deformable elements 240 and 242 are coupled with a cover plate 160 of the first guide element 60 of the transport unit 30 such that they generate a force on the bearing units 260, 262 toward the transport plane. In doing so, they are rotated about the pivot axis D. To move the bearing units 260 262 away from the transport plane, these must be moved against the press-on force of the elastically deformable elements 240, 242. The elastically deformable elements 240, 242 are designed as coil springs in the present embodiment. In other embodiments, the elastically deformable elements may also comprise other springs or an elastomer block.

In FIG. 8, a view of an apparatus 200' for aligning notes of value 12 to 18 according to a second embodiment of the invention is shown. The apparatus 200' differs from the apparatus 200 of FIGS. 1 to 8 in that additionally to a central drive unit driving the drive shaft 220' and to the drive unit 210 a further third drive unit, shown schematically in FIG. 8, is provided that drives the drive shaft 232. Elements having the same structure or the same function are identified with the same reference signs.

The roller 222 is arranged on the drive shaft 220' in a rotationally fixed manner and axially displaceable along the longitudinal axis of the drive shaft 220'. The roller 224 is arranged on the drive shaft 232 in a rotationally fixed manner and axially displaceable along the longitudinal axis of the drive shaft 232.

The rollers 222 and 224 are coupled to each other by a connecting element 226 having a circumferential toothing in the manner of a toothed rack such that they are displaceable together with the connecting element 226 along the axis of rotation of the rollers 222 and 224. In doing so, at least one of the rollers 222 and 224 is freely rotatable relative to the connecting element 226 so that the rollers 222 and 224 are drivable with different rotational speeds.

The correction of the lateral offset of a note of value 12 to 18 present between the ball-shaped counter-pressure elements 280 and 282 and the rollers 222 and 224 takes place as in the first embodiment which has been described in connection with FIGS. 1 to 7, by the displacement of the transport element 230, i.e. by the displacement of the rollers 222, 224 along their axes of rotation.

In addition to the correction of the lateral offset, an angular correction of the angle A is possible. For this, the drive unit that rotates the drive shaft 220' and the third drive unit that rotates the drive shaft 232 drive the shafts 220', 232 at different rotational speeds so that a rotation of the note of value 12 to 18 about an axis of rotation running perpendicular to the plane of the transport path 10 takes place.

Figure 9:
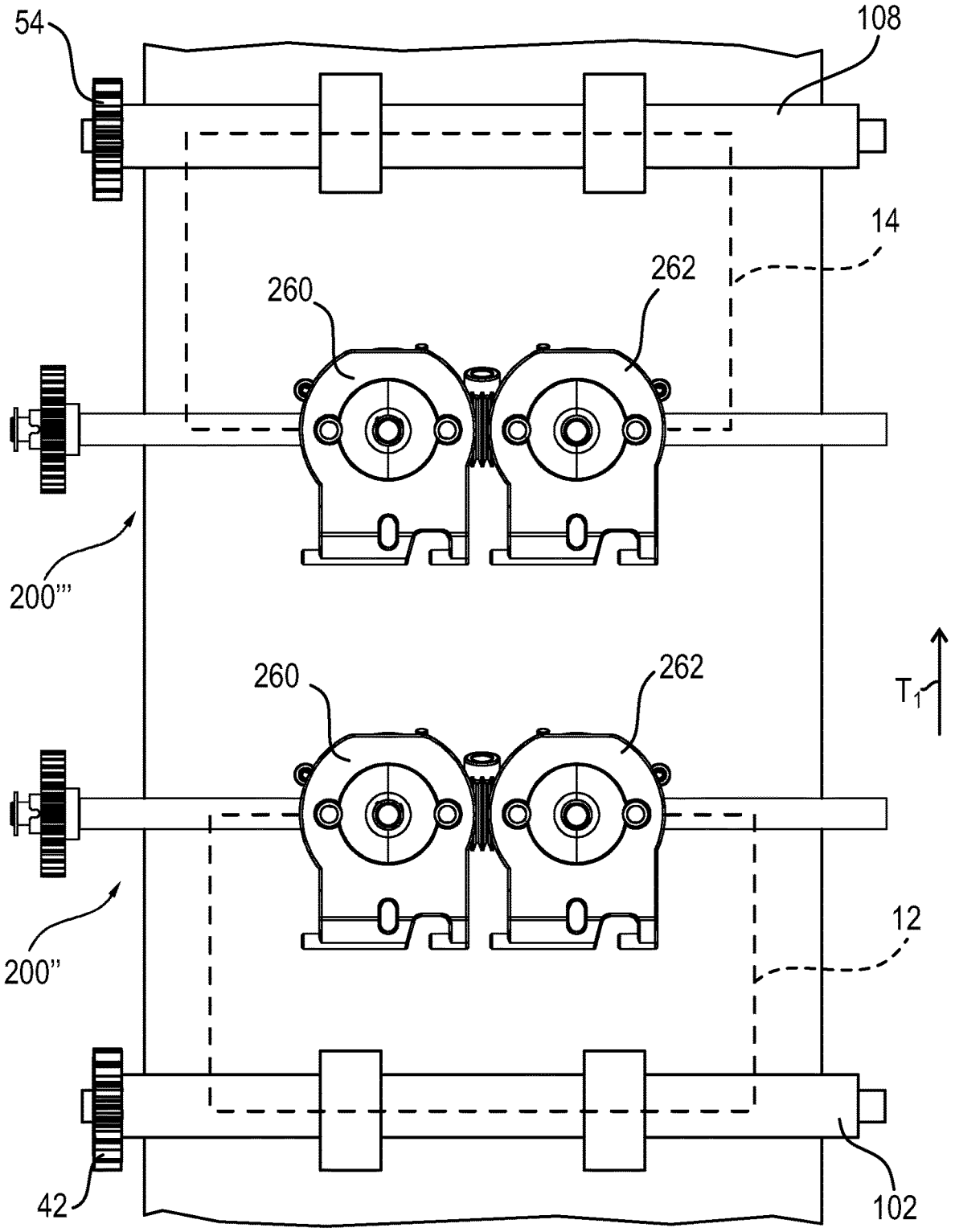
FIG. 9 shows a top view of a transport unit with a first apparatus for aligning notes of value and with a second apparatus for aligning notes of value according to a third embodiment of the invention.

FIG. 9 shows a top view of a transport unit 30 with a first apparatus 200" for aligning notes of value 12 to 18 and with a second apparatus 200'" for aligning notes of value 12 to 18 according to a third embodiment of the invention arranged downstream of the first apparatus in transport direction T1. The first apparatus 200" can be designed as the apparatus 200 or as the apparatus 200'. Likewise, the second apparatus 200'" can be designed as the apparatus 200 or as the apparatus 200'. Elements having the same structure or the same function are identified with the same reference signs.

A note of value 12 to 18 is successively fed to the apparatus 200" and the apparatus 200'" in transport direction T1. In doing so, a first alignment of the notes of value 12 to 18 fed to the apparatus by the apparatus 200" takes place and a second alignment of the notes of value 12 to 18 takes place by the apparatus 200'". In FIG. 9, the position of two notes of value 12 and 14 is illustrated by a broken line.

What is claimed is:

1. An apparatus for aligning at least one note of value along a transport path comprising:

at least one transport element driven by at least one drive unit, wherein the at least one transport element is connected to at least one drive shaft in a rotationally fixed manner and is axially displaceable thereon, wherein the at least one transport element comprises at least one roller pair, the rollers of which are connected with a connecting element having a circumferential toothing in the manner of a toothed rack and that the connecting element is arranged displaceably together with the rollers along the axis of rotation of the rollers on the at least one drive shaft;

at least one counter-pressure element arranged opposite to the at least one transport element, wherein the transport path of the at least one note of value runs between the at least one transport element and the at least one counter-pressure element, and wherein the at least one transport element driven in a first direction of rotation moves the at least one note of value arranged between the at least one transport element and the at least one counter-pressure element in a transport direction, characterized in that the at least one counter-pressure element is ball-shaped and is mounted freely rotatably, and that a second drive unit engages with the circumferential toothing in the manner of a toothed rack for displacing the at least one transport element along its axis of rotation is provided so that the at least one note of value arranged between the at least one transport element and the at least one counter-pressure element is moved upon displacement of the at least one transport element transversely to the transport direction;

wherein a first roller of the at least one roller pair is arranged on a first drive shaft of the at least one drive shaft in a rotationally fixed manner and is axially displaceable along the longitudinal axis of the first drive shaft;

wherein a second roller of the at least one roller pair is arranged on a second drive shaft of the at least one drive shaft in a rotationally fixed manner and in an axially displaceable manner along the longitudinal axis of the second drive shaft;

wherein the first drive shaft is driven by a first drive unit of the at least one drive unit and the second drive shaft is driven by a third drive unit of the at least one drive unit;

wherein the first roller and the second roller are coupled to each other such that they are displaceable together with the connecting element along the axis of rotation of the first and second rollers and at least one of the first and second rollers is freely rotatable relative to the connecting element so that the first and second rollers are drivable at different rotational speeds; and wherein the first drive unit and the third drive unit are controlled at different rotational speeds so that at the different rotational speeds a rotation of the at least one note of value about an axis of rotation running perpendicular to a plane of the transport path takes place.

2. The apparatus according to claim 1, wherein the at least one counter-pressure element presses the at least one note of value arranged between the at least one transport element and the at least one counter-pressure element against a circumferential surface of the at least one transport element.

3. The apparatus according to claim 1, wherein during a rotation of the at least one transport element by the at least one drive unit, the second drive unit displaces the at least one transport element so that a transport of the at least one note of value obliquely to the transport direction takes place.

4. The apparatus according to claim 1, wherein the second drive unit is an electric motor which drives a gearwheel that is engaged with the circumferential toothing of the connecting element.

5. The apparatus according to claim 4, wherein a toothing of the gearwheel is engaged with the circumferential toothing of the at least one transport element so that given a rotation of the gearwheel caused by the electric motor an axial displacement of the at least one transport element on the at least one drive shaft takes place.

6. The apparatus according to claim 1, wherein the transport path of the at least one note of value is delimited by a first guide element and a second guide element, wherein the first guide element is arranged with respect to the second guide element such that it is pivotable from an operating position into a maintenance position.

7. The apparatus according to claim 6, wherein at least first and second ball-shaped counter-pressure elements are provided, and that the first ball-shaped counter-pressure element is arranged in a first housing so as to be freely rotatable, and that the second ball-shaped counter-pressure element is arranged in a second housing so as to be freely rotatable, that the first and second housings are each pivotably connected to the first guide element, and wherein the first ball-shaped counter-pressure element projects through an opening of the first housing which is dimensioned such that the first ball-shaped counter-pressure element cannot completely be moved through the opening, and wherein the second ball-shaped counter-pressure element projects through an opening of the second housing which is dimensioned such that the second ball-shaped counter-pressure element cannot completely be moved through the opening of the second housing.

8. The apparatus according to claim 7 further comprising at least one elastically deformable element which generates a counter-pressure force on at least one of the first and second ball-shaped counter-pressure elements and on the at least one note of value arranged between the at least one transport element and the at least one counter-pressure element.

9. The apparatus according to claim 1, wherein the apparatus has a banknote reader which detects a position of the at least one note of value, wherein the banknote reader determines a lateral offset of the at least one note of value with respect to a preset target position, and wherein an alignment of the at least one note of value takes place in that the second drive unit for moving the at least one transport element is controlled dependent on a determined lateral offset such that the lateral offset is reduced or corrected.

10. The apparatus according to claim 1, wherein a direction of rotation of the at least one transport element can be changed so that a bidirectional transport of the at least one note of value in the transport direction and in a second transport direction opposite to the transport direction.

* * * * *